US008276322B2

(12) United States Patent
Miller

(10) Patent No.: US 8,276,322 B2
(45) Date of Patent: Oct. 2, 2012

(54) INTEGRATED MOUNTING POLE SYSTEM FOR COMMUNICATION AND SURVEILLANCE INFRASTRUCTURES

(75) Inventor: Landon Miller, Tuscaloosa, AL (US)

(73) Assignee: International Business Machines Corporation, Armonk, NY (US)

( * ) Notice: Subject to any disclaimer, the term of this patent is extended or adjusted under 35 U.S.C. 154(b) by 455 days.

(21) Appl. No.: 12/140,897

(22) Filed: Jun. 17, 2008

(65) Prior Publication Data

US 2009/0309468 A1 Dec. 17, 2009

(51) Int. Cl.
*E04H 12/00* (2006.01)
*E04C 3/00* (2006.01)
*A47B 91/00* (2006.01)

(52) U.S. Cl. ..... 52/40; 52/848; 52/301; 52/651.01; 52/651.02; 52/855; 248/349.1

(58) Field of Classification Search ..... 52/40, 153, 52/154, 301, 651.02, 834, 848, 854, 855; 248/349.1
See application file for complete search history.

(56) References Cited

U.S. PATENT DOCUMENTS

| | | | | |
|---|---|---|---|---|
| 295,905 | A * | 4/1884 | Brott | 52/834 |
| 2,985,261 | A * | 5/1961 | Kubesh | 52/120 |
| 3,034,209 | A * | 5/1962 | Bianca et al. | 29/432 |
| 3,270,480 | A * | 9/1966 | Beecker | 52/848 |
| 3,369,331 | A * | 2/1968 | Donald et al. | 52/38 |
| 4,527,225 | A * | 7/1985 | Hartman | 362/294 |
| 4,878,160 | A * | 10/1989 | Reneau et al. | 362/269 |
| 5,581,958 | A * | 12/1996 | Cote | 52/40 |
| 5,859,762 | A | 1/1999 | Clark et al. | |
| 6,173,537 | B1 * | 1/2001 | Davidsson et al. | 52/40 |
| 6,767,115 | B2 * | 7/2004 | Blackwelder | 362/385 |
| 6,873,303 | B2 * | 3/2005 | Creighton et al. | 343/890 |
| 6,912,408 | B1 * | 6/2005 | O'Neill et al. | 455/561 |
| 7,253,786 | B1 * | 8/2007 | Logozzo | 343/890 |
| 7,523,912 | B1 * | 4/2009 | Woods | 248/415 |
| 2004/0074199 | A1 * | 4/2004 | Gordin et al. | 52/726.4 |
| 2008/0136718 | A1 * | 6/2008 | Tietjen | 343/711 |

FOREIGN PATENT DOCUMENTS

CA 2495596 A1 * 8/2006

* cited by examiner

*Primary Examiner* — Brian Glessner
*Assistant Examiner* — Omar Hijaz
(74) *Attorney, Agent, or Firm* — Yudell Isidore Ng Russell PLLC

(57) ABSTRACT

An integrated mounting pole system for communication and surveillance infrastructures includes a plurality of stackable sections, which are rotationally attached to a system cabinet of the system and one another. The sections include arms supporting antennas, video cameras, and other functional devices. A conduit and/or wiring raceway thereof coupling electronic equipment disposed in the system cabinet and the functional devices propagates through interior of the sections and the arms. The system may be disposed on a trailer and may include an autonomous source of electric power.

15 Claims, 2 Drawing Sheets

INTEGRATED MOUNTING POLE SYSTEM FOR COMMUNICATION AND SURVEILLANCE INFRASTRUCTURES

CROSS REFERENCE TO RELATED APPLICATION

This application relates to commonly assigned U.S. patent application Ser. No. 12/140,906, filed concurrently herewith and titled "Integrated Mounting System For Communication And Surveillance Infrastructures." The contents of which are incorporated herein by reference in its entirety.

BACKGROUND

1. Technical Field

The present invention generally relates to communication and surveillance infrastructures and, in particular, to techniques for providing access points and gateways to communication and surveillance infrastructures.

2. Description of the Related Art

Growing number and complexity of installations for networked communication and surveillance infrastructures have lead to a need in development of automatically operable semi-stationary and mobile access points and gateways to these infrastructures adapted for installation in both urban and countryside environments.

Presently, such access points and gateways are typically specialized for operating within a framework of a single communication or surveillance network or a small number of the networks, which limits their effectiveness and increases operating and maintenance costs. Therefore, further improvements in the development of access points and gateways to communication and surveillance infrastructures are desirable.

SUMMARY OF ILLUSTRATIVE EMBODIMENTS

Disclosed is an integrated mounting pole system used in communication and surveillance infrastructures as a semi-permanent, temporary, and movable access point, gateway, terminal, or server for urban and countryside installations.

In embodiments of the present invention, the integrated mounting pole system comprises a plurality of stackable sections that are rotationally affixed to one another and disposed on a system cabinet attached to a mounting plate adapted for affixing to a supporting medium. The sections include arms extending therefrom and supporting various communicating, surveillance, and solar devices, such as antennas, video cameras, sensors, photovoltaic panels, and the like. A conduit coupling the devices to electronic equipment thereof disposed in the system cabinet propagates through openings interconnecting interiors of the arms, sections, and system cabinet. The integrated mounting pole system may be mounted on a transportation platform (e.g., trailer) and includes an autonomous source of electric power.

The above as well as additional features and advantages of the present invention will become apparent in the following detailed written description.

BRIEF DESCRIPTION OF THE DRAWINGS

The invention itself will best be understood by reference to the following detailed description of an illustrative embodiment when read in conjunction with the accompanying drawings, wherein.

DETAILED DESCRIPTION OF AN ILLUSTRATIVE EMBODIMENT

Figure 1:
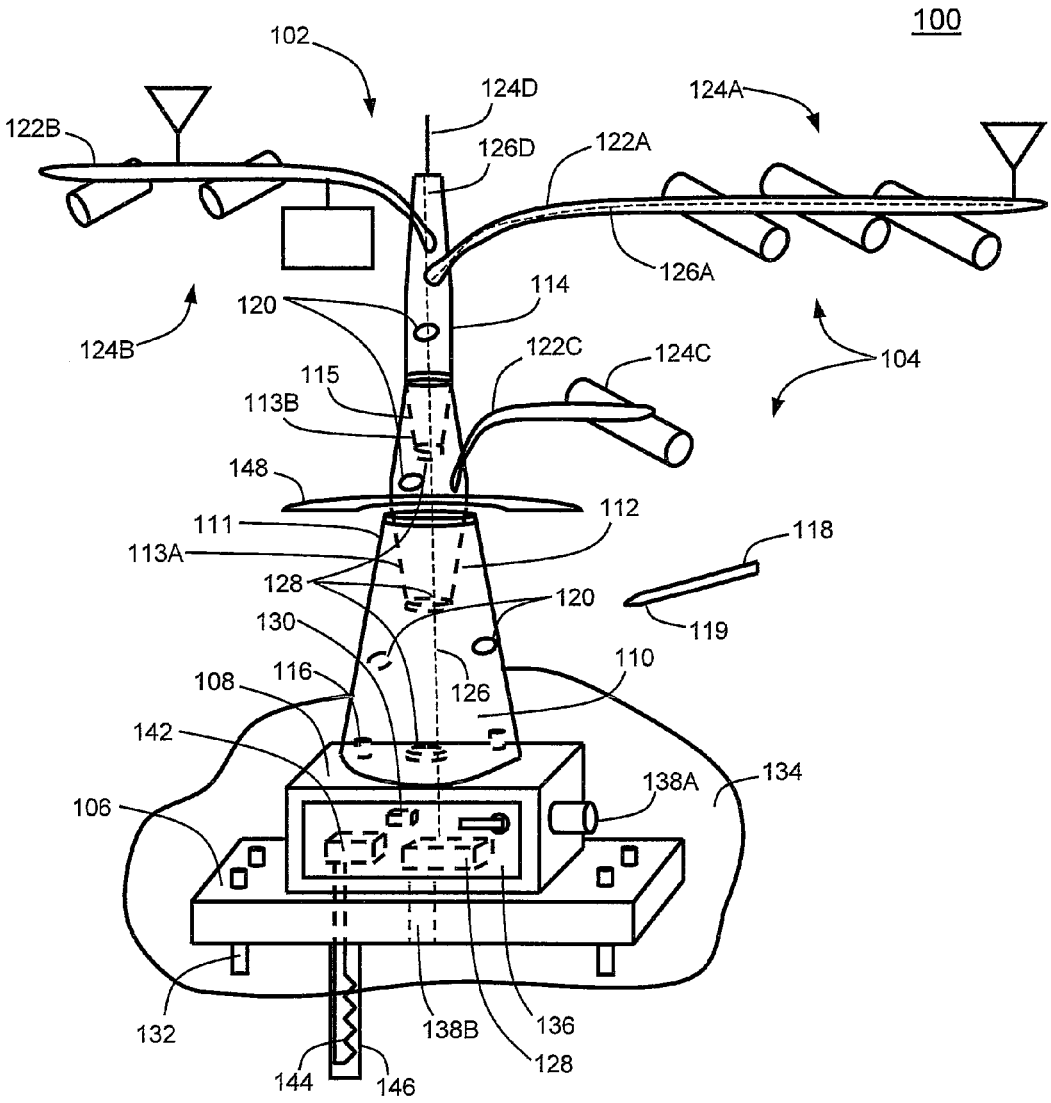
FIG. 1 depicts an integrated mounting pole system for communication and surveillance infrastructures, according to one embodiment of the invention.

The illustrative embodiments provide an integrated mounting pole system for communication and surveillance infrastructures, in which such a system may be used as a semi-permanent, temporary, and movable access point, gateway, terminal, or server.

In the following detailed description of exemplary embodiments of the invention, specific exemplary embodiments in which the invention may be practiced are described in sufficient detail to enable those skilled in the art to practice the invention, and it is to be understood that other embodiments may be utilized and that mechanical, electrical, and other changes may be made without departing from the spirit or scope of the present invention. The following detailed description is, therefore, not to be taken in a limiting sense, and the scope of the present invention is defined only by the appended claims.

Within the descriptions of the figures, similar elements are provided similar names and reference numerals as those of the previous figure(s), except that suffixes may be added, when appropriate, to differentiate such elements. The specific numerals assigned to the elements are provided solely to aid in the description and not meant to imply any limitations (structural or functional) on the invention.

It is understood that the use of specific component, device and/or parameter names are for example only and not meant to imply any limitations on the invention. The invention may thus be implemented with different nomenclature/terminology utilized to describe the components/devices/parameters herein, without limitation. Each term utilized herein is to be given its broadest interpretation given the context in which that term is utilized. Specifically, as utilized herein, the terms "functional devices" and "electronic equipment" broadly refer to electronic, wireless, and opto-electronic devices at least in part implementing communication and surveillance functions and operating within a framework of respective networks or independent therefrom.

With reference now to the figures, FIG. 1 depicts an exemplary integrated mounting pole (IMP) system 100 for urban and countryside installations according to one embodiment of the invention. IMP system 100 includes structural unit 102 and electronic equipment 104 and may be configured for automatic operation within a plurality of communication and/or surveillance infrastructures. In some embodiments (not shown), IMP system 100 may additionally include an optional autonomous source of electric power.

Structural unit 102 comprises mounting plate 106, system cabinet 108 disposed on mounting plate 106, base section 110 rotationally affixed to system cabinet 108, at least one middle section 112 (one section 112 is shown), and top section 114. Components of structural unit 102 may be fabricated from metals, fiberglass, composites, or plastics.

Structural unit 102 may also include (not shown) seals, gaskets, and covers preventing interior of the structural unit from ingress of moisture or water, fixtures preventing unauthorized access to components of electronic equipment 104 or climbing on the structural unit (anti-climbing dish 148 is shown), as well as components adapted for securing and stabilizing portions thereof, and the like auxiliary elements and devices.

Mounting plate 106 (for example, concrete, metal, or composite mounting plate) is provided with fasteners 132 for affixing to foundation 140 supporting IMP system 100 at a particular installation site. In the depicted embodiment, illustratively, fasteners 132 are studs adapted for affixing IMP system 100 to the foundation such as concrete slab 134 or ground.

System cabinet 108 is provided with a lockable door 136 and port 138, which is used as an entry point for incoming/outgoing power and signal cables. Alternatively, for receiving in-ground power or signal cables, additional port 138 may be disposed in the bottom portion of system cabinet 108.

In some embodiments (not shown), system cabinet 108 includes shelves, racks, guides, and the like elements providing mechanical support for contents of the cabinet. In the depicted embodiment, system cabinet 108 also comprises cooling unit 142 having heat-exchanging element 144 adapted for in-ground installation (as shown, in bore hole 146 drilled in earth beneath concrete slab 134). In alternate embodiments, system cabinet 108 may include thermo-electric coolers, fans, heaters, thermostats, dehumidifiers, and other climate-controlling devices.

Each of sections 110, 112, and 114 includes at least one conical end adapted for coupling with a conical end of an adjacent section and rotationally supporting that end or for being rotationally supported by a conical end of the adjacent section. For example, conical end 111 of base section 110 receives and rotationally supports conical end 113A of middle section 112, which other conical end 113B receives and rotationally supports conical end 115 of top section 114.

Base section 110 is attached to system cabinet 108 using hardware 116. In some embodiments, the coupling between base section 110 and system cabinet 108 may allow for rotational movement of base section 110 about a vertical axis thereof. In one embodiment, rotational alignments of base section 110 relative to system cabinet 108 and rotational alignments of middle and top sections 112 and 114 relative to one another or system cabinet 108 and base section 110 may be performed using lever 118. In the depicted embodiment, section 110, 112, and 114 are illustratively provides with holes 120 adapted for receiving guiding end 119 of lever 118.

Each of sections 110, 112, and 114 may include one or more arms 122 (arms 122A, 122B connected to top section 114 and arm 122C connected to middle section 112 are shown) connected thereto in a fixed or rotationally adjustable relationship. Arms 122 support, in pre-selected spatial orientations, external elements 124 of electronic equipment 104.

External elements 124 generally include antennas, video cameras, infra-red cameras, motion detectors, radio-frequency identification (RFID) sensors, phased array, high-frequency generators and receivers, and the like functional components of electronic, wireless, and opto-electronic communication and surveillance devices and systems of electronic equipment 104. Some external elements of electronic equipment 104 may also be mounted directly on enclosures of the sections of structural unit 102. For example, cellular, Wi-Fi, microwave, or ZigBee antenna 124D is disposed on top section 114. In some embodiments, external elements 124 further include solar devices (e.g., photovoltaic panels), wind generators, fuel cells, and other mechanical and biological electrical generating elements, which may be used as supplemental and backup sources of electric power for components of electronic equipment 104.

Electronic equipment 104 also includes transceivers, video/voice/data processors, networking adapters (all collectively denoted with a reference numeral 128), power supplies, depleteable, rechargeable or fuel cell batteries (all collectively denoted with a reference numeral 130), and other components, which are disposed in systems cabinet 108 and electrically coupled to respective external elements 124 via electrical conduit, or wiring, 126.

Contents of system cabinet 108 and other components of electronic equipment 104 may be provided with Global Positioning System (GPS) and RFID traceable sensors and interlocks, which are intended for monitoring the location of IMP system 100 and protecting equipment 104 from theft or damage.

Conduit 126 propagates through openings in 128, which interconnect interiors of systems cabinet 108 and sections 110, 112, and 114. In some embodiments, portions of conduit 126 are disposed in wiring raceways. Branches of conduit 126 extend to external elements 124 of electronic equipment 104 through arms 122 (branch 126A extending to external elements 124A and branch 126D extending to external element 124D are shown). Generally, arms 122 are hollow structures (e.g., tubes), which are adapted for concealing and protecting the branches of conduit 126.

IMP system 100 may at least partially be assembled prior to on-site installation. For example, sections 110, 112, and 114 may be connected together and to system cabinet 108 installed on mounting plate 106. Then, after arms 122 are attached to intended sections 110, 112, and 114, cables and component wires/cables of conduit 126 and branches thereof are pulled through sections 110, 112, and 114 and arms 122 to mounting pads of external elements 124.

The remaining portions of electronic equipment 104 may be either pre-installed or installed in system cabinet 108 after heat-exchanging element 144 is embedded in earth and structural unit 102 is affixed to supporting medium 140 (e.g., concrete slab 134). Installation of IMP system 100 is completed after connecting system cabinet 108, via port 138, to on-site power/signal cables, rotational alignment of sections 110, 112, and 114, and spatial alignment of external elements 124.

Figure 2:
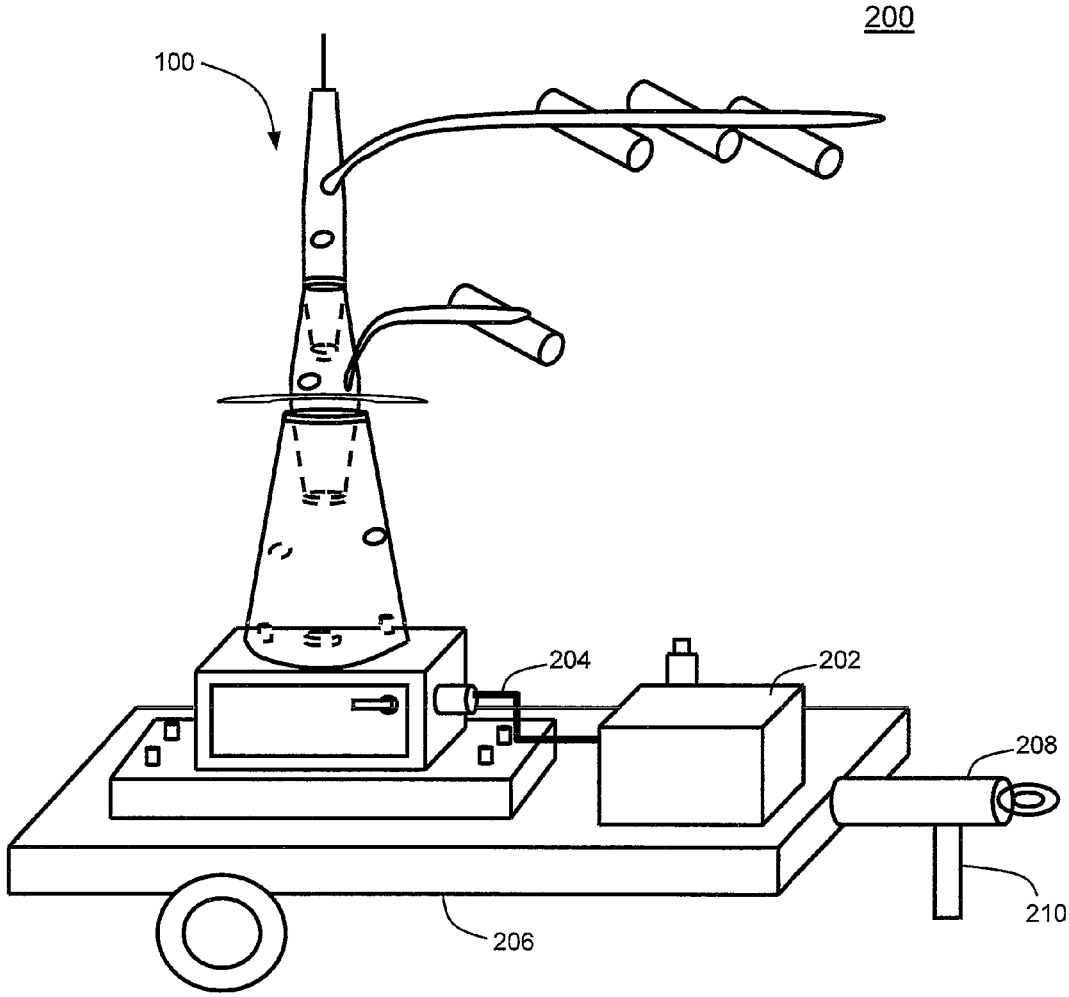
FIG. 2 depicts a transportable integrated mounting pole system for communication and surveillance infrastructures, according to another embodiment of the invention.

Referring to FIG. 2, in another embodiment of the invention, an exemplary transportable IMP system 200 comprises IMP system 100, optional electric power generator 202 coupled to IMP system 100 via interconnecting cable 204, and transportation platform 206. IMP system 100 and power generator 202 are attached to platform 206 in a fixed spatial relationship to one another and may be transported thereon by motorized vehicles, such as cars, trucks, or tractors.

Generally, IMP system 200 is operational when platform 206 is in a stationary position, however, in some embodiments, at least a portion of the functions of IMP system 200 may be enabled on moving transportation platform 206. Transportation platform 206 is generally a trailer, which is provided with hitch 208 for coupling to a transporting vehicle (not shown) and a support 210 used to stabilize the platform during periods of on-site installations.

Power generator 202 is typically an autonomous source of electric power (e.g., diesel or gasoline engine/electric generator unit, replenishable fuel cell or the like), which is capable of powering IMP system 200 and/or re-charging internal batteries thereof for extended durations of time. In some embodiments, power generator 202 serves as a main source of electric power for IMP system 100. In alternate embodiments, power generator 202 may be used as a backup power source, which complements on-site source(s) of electric power.

Those of ordinary skill in the art will appreciate that configurations depicted in FIGS. 1 and 2 may vary. For example, other hardware and electrical/electronic components may be used in addition to or in place of the depicted components and devices. Therefore, the architectures depicted in FIGS. 1 and 2 are basic illustrations of IMP system 100 and 200, for which actual implementations may vary. Thus, the depicted examples are not meant to imply mechanical, structural, electrical, electronic, or architectural limitations with respect to the present invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. An integrated mounting pole system for communication/surveillance infrastructures, the system comprising:

a trailer;

a mounting plate attached to the trailer;

a system cabinet disposed on the mounting plate; and a plurality of stackable sections including a base section rotationally attached to the system cabinet, a top section, and a middle section disposed between the base section and the top section, wherein the base section includes a conical end configured to receive a first conical end of the middle section, the middle section includes a second conical end, opposite the first conical end, configured to receive a conical end of the top section and the system cabinet and the sections each include one or more openings that connect interiors of the system cabinet, the base section, the middle section, and the top section to each other, and wherein the first and second conical ends of the middle section are both narrower than an intermediate portion of the middle section that is located between the first and second conical ends of the middle section.

2. The system of claim 1, wherein a selected one of the sections further comprises an arm extending from an outer surface of the selected one of the sections, wherein the arm is configured for supporting one or more functional devices or components.

3. The system of claim 2, wherein the arm and the selected one of the sections are connected in a fixed or rotationally adjustable relationship.

4. The system of claim 2, further comprising a conduit including one or more electrical conductors extending through the openings and interconnecting equipment disposed in the system cabinet and the functional devices or components.

5. The system of claim 4, wherein the arm is configured to conceal portions of the conduit that extend into the arm.

6. The system of claim 2, wherein the functional devices are selected from the group consisting of communication devices, surveillance devices, and solar devices.

7. The system of claim 2, wherein electronic components facilitating operability of the functional devices are disposed in the system cabinet.

8. The system of claim 1, wherein the openings in the sections are formed in the conical ends of the sections.

9. The system of claim 1, wherein the system cabinet comprises at least one port for cables coupling the system to an external source of electric power and/or at least one communication or surveillance network.

10. The system of claim 1, further comprising a cooling unit having a heat-exchanging element adapted for in-ground installation.

11. The system of claim 1, further including an internal or external source of electric power or both.

12. An integrated mounting pole system for communication/surveillance infrastructures, the system comprising:

a trailer;

a mounting plate attached to the trailer;

a system cabinet disposed on the mounting plate; and a plurality of stackable sections including a base section rotationally attached to the system cabinet, a top section, and a middle section disposed between the base section and the top section, wherein the base section includes a conical end configured to receive a first conical end of the middle section, the middle section includes a second conical end, opposite the first conical end, configured to receive a conical end of the top section and a selected one of the sections includes an arm extending from an outer surface of the selected one of the sections that is configured for supporting one or more functional devices or components, and the system cabinet, the sections, and the arm each include one or more openings that connect interiors of the system cabinet, the base section, the middle section, the top section, and the arm to each other, and wherein the first and second conical ends of the middle section are both narrower than an intermediate portion of the middle section that is located between the first and second conical ends of the middle section.

13. The system of claim 12, wherein the openings in the sections are formed in the conical ends.

14. The system of claim 12, further comprising a conduit and/or wiring raceway thereof propagating through at least some of the openings.

15. The system of claim 14, wherein:

the functional devices are selected from the group consisting of communication devices, surveillance devices, and solar devices;

the arm is configured to conceal portions of the conduit extending into the arm;

electronic components facilitating operability of the functional devices are disposed in the system cabinet; and the system cabinet comprises at least one port for cables coupling the system to an external source of electric power and/or at least one communication or surveillance network.

* * * * *